US005276939A

United States Patent [19]

Uenishi

[11] Patent Number: 5,276,939

[45] Date of Patent: Jan. 11, 1994

[54] ELECTRIC VACUUM CLEANER WITH SUCTION POWER RESPONSIVE TO NOZZLE CONDITIONS

[75] Inventor: Tomoaki Uenishi, Kasai, Japan

[73] Assignee: Sanyo Electric Co., Ltd., Osaka, Japan

[21] Appl. No.: 834,593

[22] Filed: Feb. 12, 1992

[30] Foreign Application Priority Data

Feb. 14, 1991 [JP] Japan ..... 3-020992

[51] Int. Cl.[5] ..... A47L 9/28

[52] U.S. Cl. ..... 15/319; 15/339

[58] Field of Search ..... 15/319, 339

[56] References Cited

U.S. PATENT DOCUMENTS 4,654,924 4/1987 Getz et al. ..... 15/319
4,953,253 4/1990 Fukuda et al. ..... 15/319
4,958,406 9/1990 Toyoshima et al. ..... 15/319

FOREIGN PATENT DOCUMENTS 0136357 4/1985 European Pat. Off. .
0320878 6/1989 European Pat. Off. .
0467347 1/1992 European Pat. Off. .
2063659 6/1981 United Kingdom .

OTHER PUBLICATIONS

Patent Abstract of Japan (Masushita Denki Sangyo KK) JP-A-58 099295.

*Primary Examiner*—Chris K. Moore
*Attorney, Agent, or Firm*—Thomas R. Morrison

[57] ABSTRACT

An electric vacuum cleaner has a main body with a blower and a dust-collecting chamber, a triac that controls the blower, a floor nozzle coupled to the main body, a sensor that senses the current in a motor in the floor nozzle that drives its rotary brush, and a microcomputer. At a predetermined interval, the sensor sends a representative value of the current for that interval, which may be the maximum value, to the microcomputer. The microcomputer determines the duty cycle of the triac by performing a fuzzy interference procedure on the values that sent. Thus the supply of current to the blower can be varied automatically according to the conditions of use of the floor nozzle and the kind of floor surface cleaned.

6 Claims, 19 Drawing Sheets

LOOK UP TABLE (DUTY CYCLE OF TRIAC)

| | | | | | |
|---|---|---|---|---|---|
| LARGE | 151 | 149 | 146 | 143 | 118 |
| ELECTRIC CURRENT → | 146 | 130 | 114 | 118 | 93 |
| | 89 | 93 | 93 | 89 | 89 |
| | 86 | 86 | 86 | 86 | 86 |
| SMALL ← | 99 | 99 | 99 | 99 | 99 |

SMALL ← TIME → LARGE

RULE (1)
ELECTRIC CURRENT IS LARGE
0

TIME IS ABOUT MEDIUM
0

INPUT IS LARGE

RULE (2)
ELECTRIC CURRENT IS ABOUT MEDIUM
0.6

TIME IS SOMEWHAT SHORT
0.7

INPUT IS SOMEWHAT LARGE
0.6

ELECTRIC VACUUM CLEANER WITH SUCTION POWER RESPONSIVE TO NOZZLE CONDITIONS

BACKGROUND OF THE INVENTION

1. Field of the Invention

The present invention relates to an electric vacuum cleaner and, more particularly, to an electric vacuum cleaner in which input to an electric blower is automatically controlled in response to operating conditions of a floor nozzle.

2. Description of the Background Art

Conventionally, a technique has been proposed for improving an electric vacuum cleaner by varying the power supplied to an electric blower in accordance with the magnitude of the suction and the amount of dust collected in a dust collecting chamber. Such a conventional technique includes a pressure detecting device provided in an air inlet passage between an electric blower and a filter. The pressure in the dust collecting chamber measured by the pressure detecting device, and power to the electric blower is varied according to the detected pressure value. An electric vacuum cleaner using such a technique is disclosed, for example, in Japanese Patent Laying-Open No. 57-75623 (1982).

In such a conventional technique, however, input to the electric blower is varied only with the pressure in the dust collecting chamber, and it is difficult to optimize control to actual operating conditions of a floor nozzle performing dust collection and a floor surface subject to dust collection.

For example, in the case of the surface of a floor of board floor, a suction port of the electric vacuum cleaner tends to cling to the floor surface. Once it clings to the floor, the pressure in an air inlet passage is lowered. In such a case, input to the electric blower is increased in accordance with the decrease of to make the suction still greater, so that the suction port clings more strongly to the floor surface in the above-described conventional technique. As described above, in power to the conventional electric vacuum cleaner, control of the electric blower adapted to actual conditions of the floor nozzle and the floor surface is not performed, and operation of the vacuum cleaner is not improved.

Another approach is disclosed in Japanese Patent Laying-Open No. 64-52430 (1989), for example, in which suction power that varies with actual conditions of a floor nozzle and a floor surface is realized by sensing a change in electric current in a driving motor of a dust collecting rotary brush provided in a floor nozzle of an electric vacuum cleaner and automatically controlling power to an electric blower on the basis of the sensed current.

However, during normal cleaning, a variation in the electric current in the motor driving the rotary brush is extremely small; little change occurs in the average electric current. Therefore, it is difficult to control the electric blower precisely in accordance with actual conditions of the floor nozzle and the floor surface by controlling only power to the electric blower in proportion to the current in the driving motor of the rotary brush, as in the case of the above-described conventional technique.

Another electric vacuum cleaner is disclosed in Japanese Patent Laying-Open No. 3-26223 (1991), for example, in which fuzzy inference is performed on the speed of a floor nozzle's motion and the amount of dust in the sucked air, and suction power is controlled on the basis of the result.

However, in this electric vacuum cleaner, the speed of the floor nozzle is measured only by the of rotation of a roller attached to the floor nozzle; the sliding of the floor nozzle is not considered. Therefore, the actual conditions of use of the floor nozzle are not sufficiently reflected in the control of the suction.

OBJECTS AND SUMMARY OF THE INVENTION

An object of the present invention is to provide an electric vacuum cleaner capable of realizing optimum suction that varies with actual conditions of a floor nozzle and a floor surface.

Another object of the present invention is to provide an electric vacuum cleaner capable of precisely determining actual conditions of a floor nozzle and a floor surface in a manner close to human sense perception by controlling an electric blower using fuzzy inference to realize optimum suction.

In brief, the present invention provides an electric vacuum cleaner comprising a main body having an electric blower and a dust collecting chamber, a floor nozzle coupled to the main body and having a rotary brush and a motor for driving the rotary brush, an electric current sensor for detecting current flowing in the brush driving motor, a circuit for evaluating an interval of variation of the motor current from an output of the electric current sensor, and a control circuit for performing a predetermined mathematical operation on the evaluated interval and controlling power to the electric blower on the basis of the results.

According to another aspect of the present invention, an electric vacuum cleaner comprises a main body having an electric blower and a dust collecting chamber, a floor nozzle coupled to the main body and having a rotary brush and a motor for driving the rotary brush, an electric current sensor for detecting current flowing in the brush driving motor, a circuit for evaluating an interval of variation of the motor current from an output of the electric current sensor, a circuit for detecting the maximum value of the motor current for every predetermined interval from the output of the electric current sensor, and a control circuit for performing a predetermined mathematical operation on the evaluated interval and the detected maximum current and controlling power to the electric blower on the basis of the results.

According to still another aspect of the present invention, the predetermined mathematical operation includes fuzzy inference which makes at least the evaluated interval an input variable and the power supplied to the electric blower a conclusion part.

Accordingly, a main advantage of the present invention is that a predetermined mathematical operation is performed on an interval of variable current flow in a brush driving motor, and the supply of power to an electric blower is controlled on the basis of a result of it, so that it is possible to supply optimum power to the electric blower in accordance with conditions of use of a floor nozzle so as to realize optimum suction.

Another advantage of the present invention is that a predetermined mathematical operation is performed on an interval of variable current flow in the brush driving motor and the maximum value of the current obtained for every predetermined interval. The power supplied to the electric blower varies with the result, so that optimal power to the electric blower is supplied in accordance with the conditions of use of the floor nozzle and the types of floor surface to realize optimum suction.

Still another advantage of the present invention is that fuzzy inference is used at least in an mathematical operation on the detected interval, so that to realize automatic input control of the blower is adapted to human experience and intuition with a simple configuration.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 7(A)' is an enlargement of the section of FIG. 7(A) within the ellipse bounded by a dashed line.

FIG. 21 is a graph illustrating a membership function of rule 7 of an embodiment of the present invention.

DESCRIPTION OF THE PREFERRED EMBODIMENTS

Figure 1:
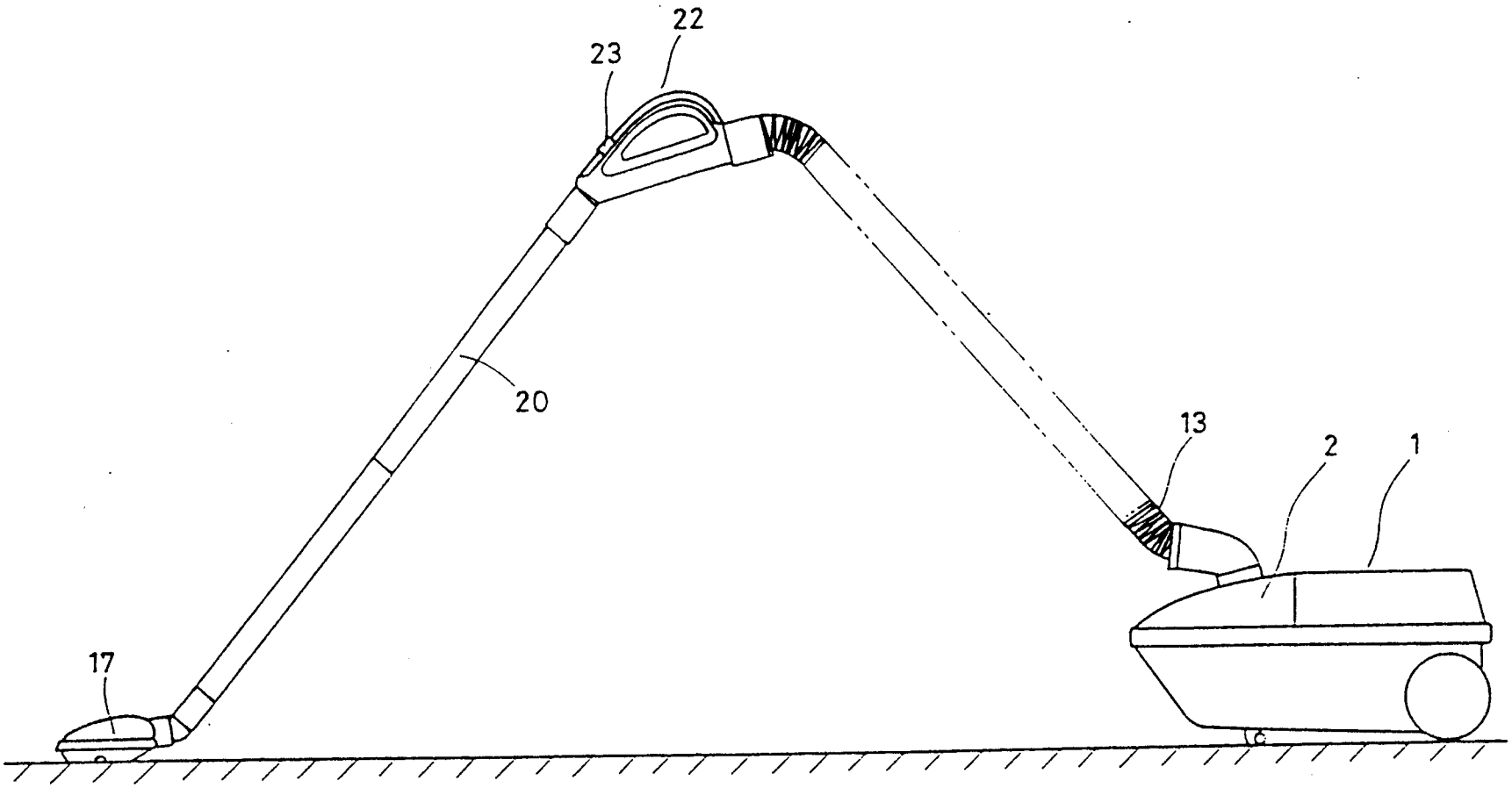
FIG. 1 is an exterior side view of an electric vacuum cleaner according to an embodiment of the present invention.

Referring to FIG. 1, an electric vacuum cleaner according to an embodiment of the present invention includes a main body 1, a suction hose 13 having an end attached to a suction port of a lid 2 provided in a front part of main body 1, a handle part 22 provided at another end of hose 13 and having a sliding operation part 23, an extension pipe 20 connected to handle part 22, and a floor nozzle 17 connected to the tip of extension pipe 20.

Figure 2:
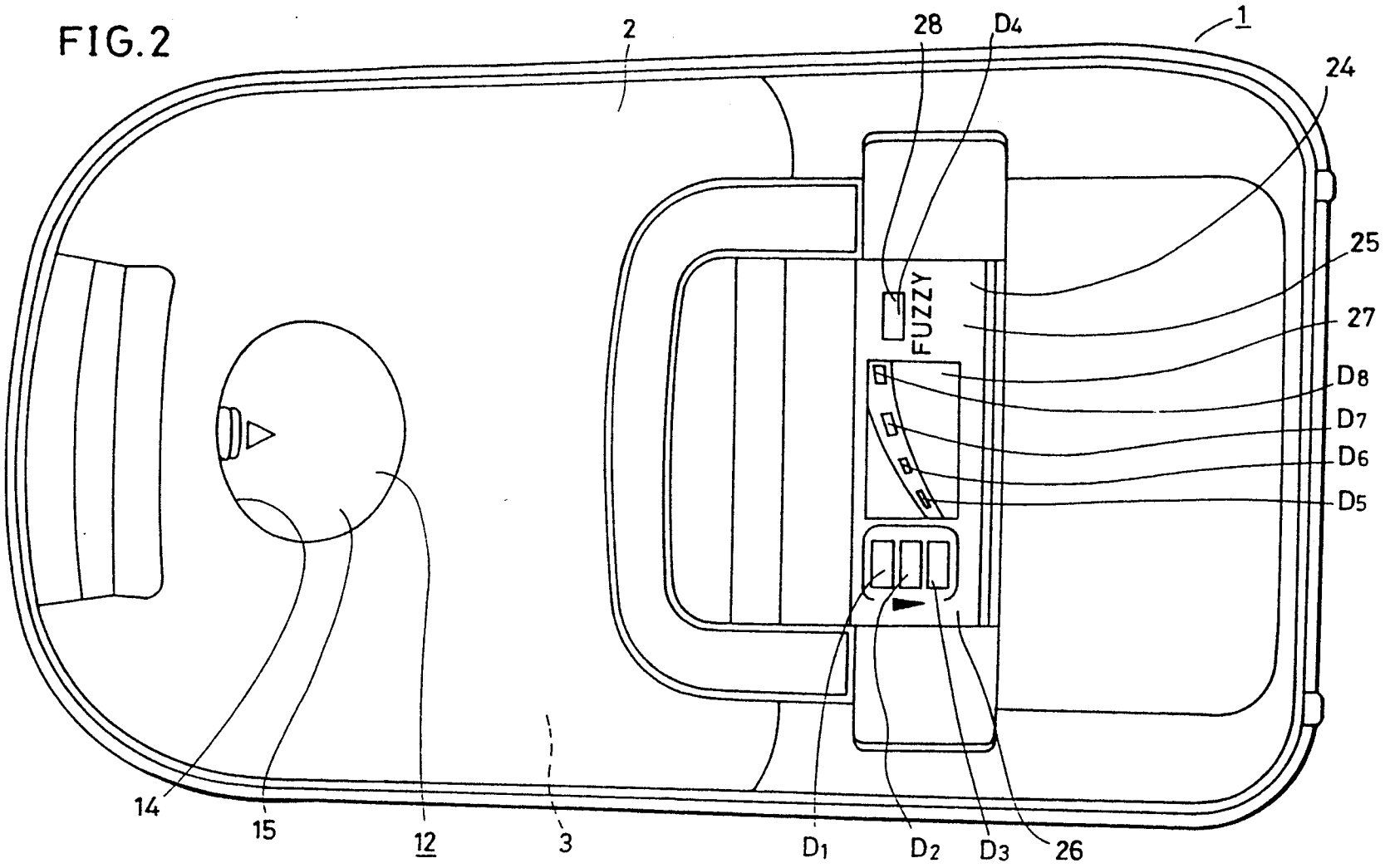
FIG. 2 is a plan view of a main body of an electric vacuum cleaner according to an embodiment of the present invention.
Figure 3:
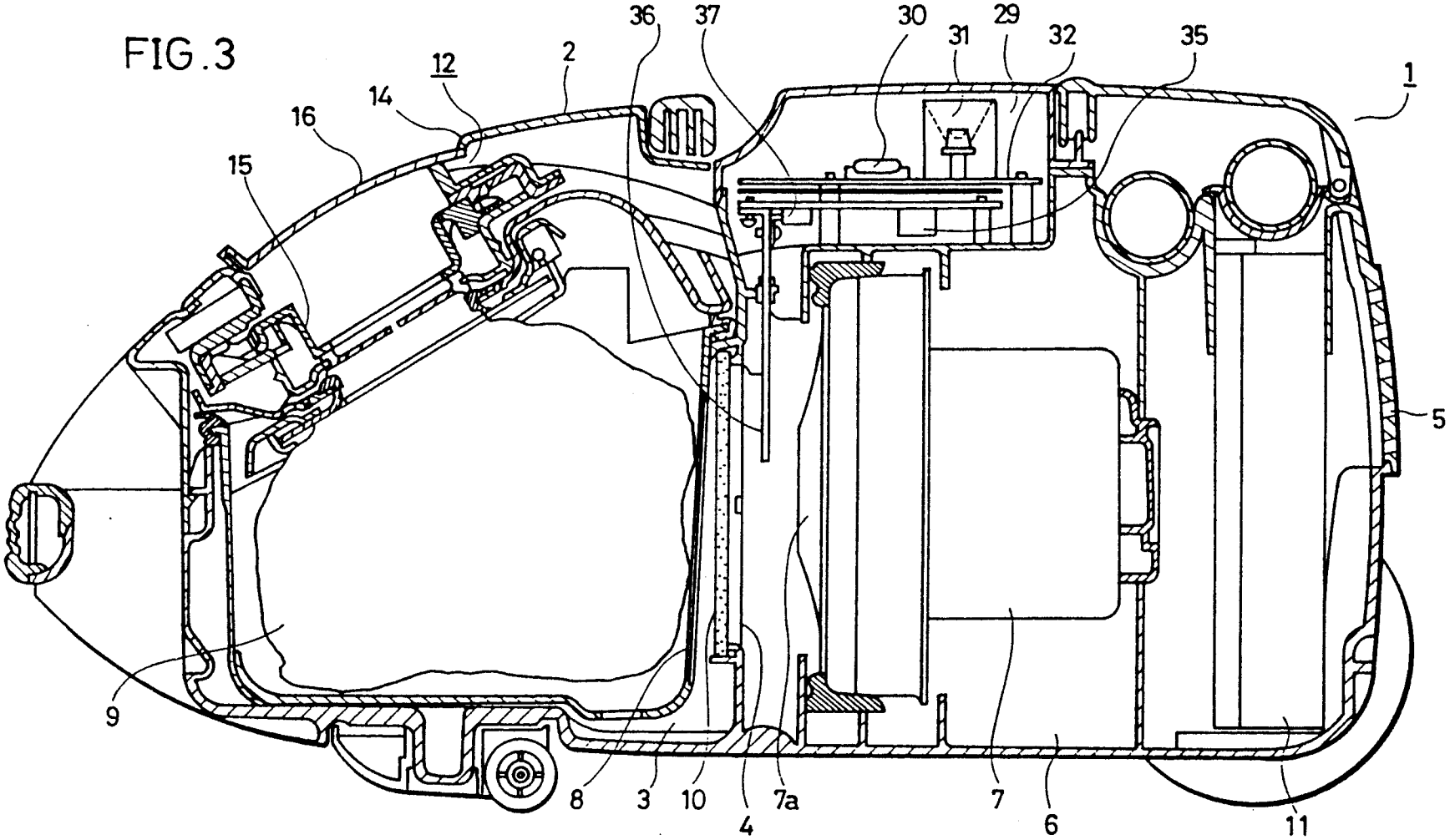
FIG. 3 is a cross sectional side view of a main body of an electric vacuum cleaner according to an embodiment of the present invention.

Referring to FIGS. 2 and 3, a dust collecting chamber 3 having an opening to be opened and closed by lid 2 on the upper surface is provided in a front part of main body 1 of the electric vacuum cleaner. A blower accommodating chamber 6 is provided in a rear part of main body 1, and blower chamber 6 communicates with dust collecting chamber 3 through a vent hole 4. An exhaust port 5 is formed on the back wall of blower chamber 6.

An electric blower 7 is accommodated in blower chamber 6, and a suction port 7a of electric blower 7 communicates with dust collecting chamber 3 in an airtight manner A box type filter 8 permeable to air is accommodated in an attachable/detachable manner in dust collecting chamber 3, and a paper bag filter 9 is accommodated in an attachable/detachable manner in box type filter 8. A suction filter 10 is provided in front of (at the suction side of) electric blower 7, and an exhaust filter 11 is provided in the rear (at the exhaust side) thereof.

A suction port part 12 to which suction hose 13 (FIG. 1) is coupled in a rotatable manner is provided in lid 2 in the front part of main body 1. Suction port part 12 includes a suction port 14, a hose coupling nozzle 15 for holding suction hose 13 in a rotatable manner, and a slide-type shutter plate 16 placed in an upper part of hose coupling nozzle 15 for opening/closing suction port 14.

Referring to FIG. 2, a function displaying part 24 is provided in a central part of an upper surface of main body 1, and function displaying part 24 is implemented so that a display of a corresponding function is lit on a display panel plate 25 by illuminating it from behind with a light emitting diode. Function displaying part 24 includes a dust amount displaying part 26, a power control displaying part 27, and a fuzzy control displaying part 28. Dust amount displaying part 26 is illuminated with light from one of three light emitting diodes D1–D3 to display the amount of dust in paper bag filter 9 (FIG. 3). Power control displaying part 27 is illuminated with light from one of four light emitting diodes D5–D8 to display the suction of electric blower 7 with notch display of four steps, i.e. (weak), (medium), (strong), and (high power). Fuzzy control displaying part 28 is illuminated with light emitting diode D4 to display that a fuzzy set procedure is controlling electric blower 7. When electric blower 7 is manually controlled, light emitting diode D4 is turned off.

Referring to FIG. 3, a control board accommodating chamber 29 is formed in an upper part of blower chamber 6 of main body 1. A control circuit board 32 on which a control circuit device 30, light emitting diodes D1–D8, a reflecting plate 31 and so forth are provided is disposed in control board accommodating chamber 29, which is covered with display panel plate 25. An electric current sensor 35 and a blower control triac 37 are also attached to control circuit board 32. Electric current sensor 35 measures electric current in a brush driving motor 19 in FIG. 5 which will be described later. Blower control triac 37 includes a radiator plate 36 arranged in a space in the vicinity of suction port 7*a*.

Figure 4:
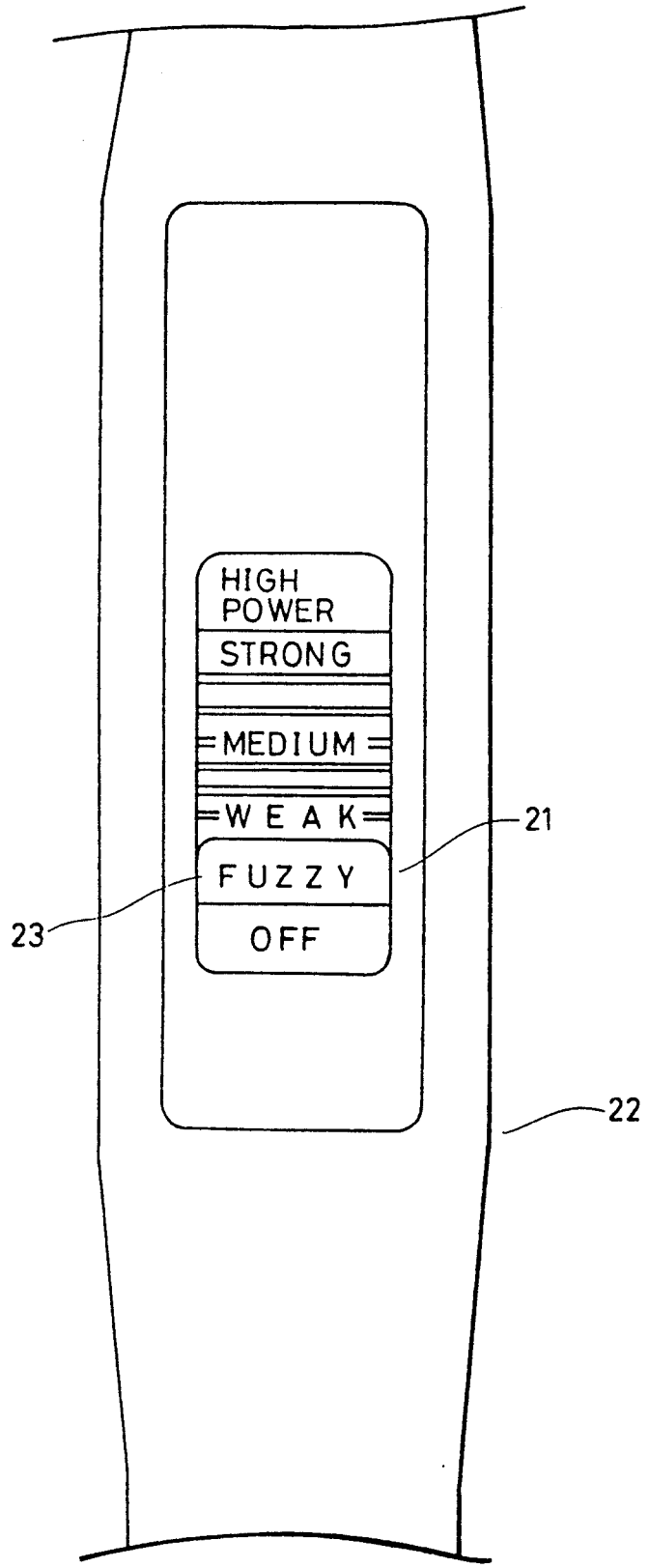
FIG. 4 is a plan view of a handle part of an electric vacuum cleaner according to an embodiment of the present invention.

Referring to FIG. 4, Handle part 22 has an operation part 21, including a sliding operation part 23, on its surface. Sliding operation part 23 is for changing control of electric blower 7 by changing the position of a slider of a variable resistor (not shown), and it has operation setting positions, "off" indicating, a stop position, "fuzzy" indicating, a fuzzy control position, and "weak - high power" indicating, a manual control position.

Figures 5, 11:
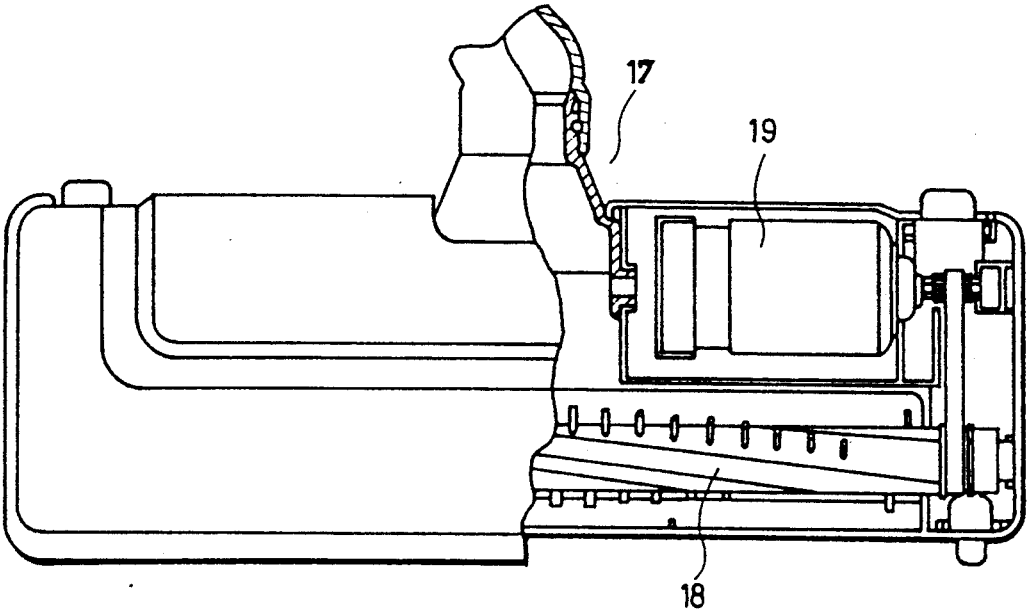
FIG. 5 is a partial cross sectional top view of a floor nozzle of an electric vacuum cleaner according to an embodiment of the present invention.
FIG. 11 is a diagram illustrating a look up table used in controlling an electric blower according to an embodiment of the present invention.

Referring to FIG. 5, a floor nozzle 17 includes at its inside a dust collecting rotary brush 18 and a brush driving motor 19 for driving rotary brush 18.

Figure 6:
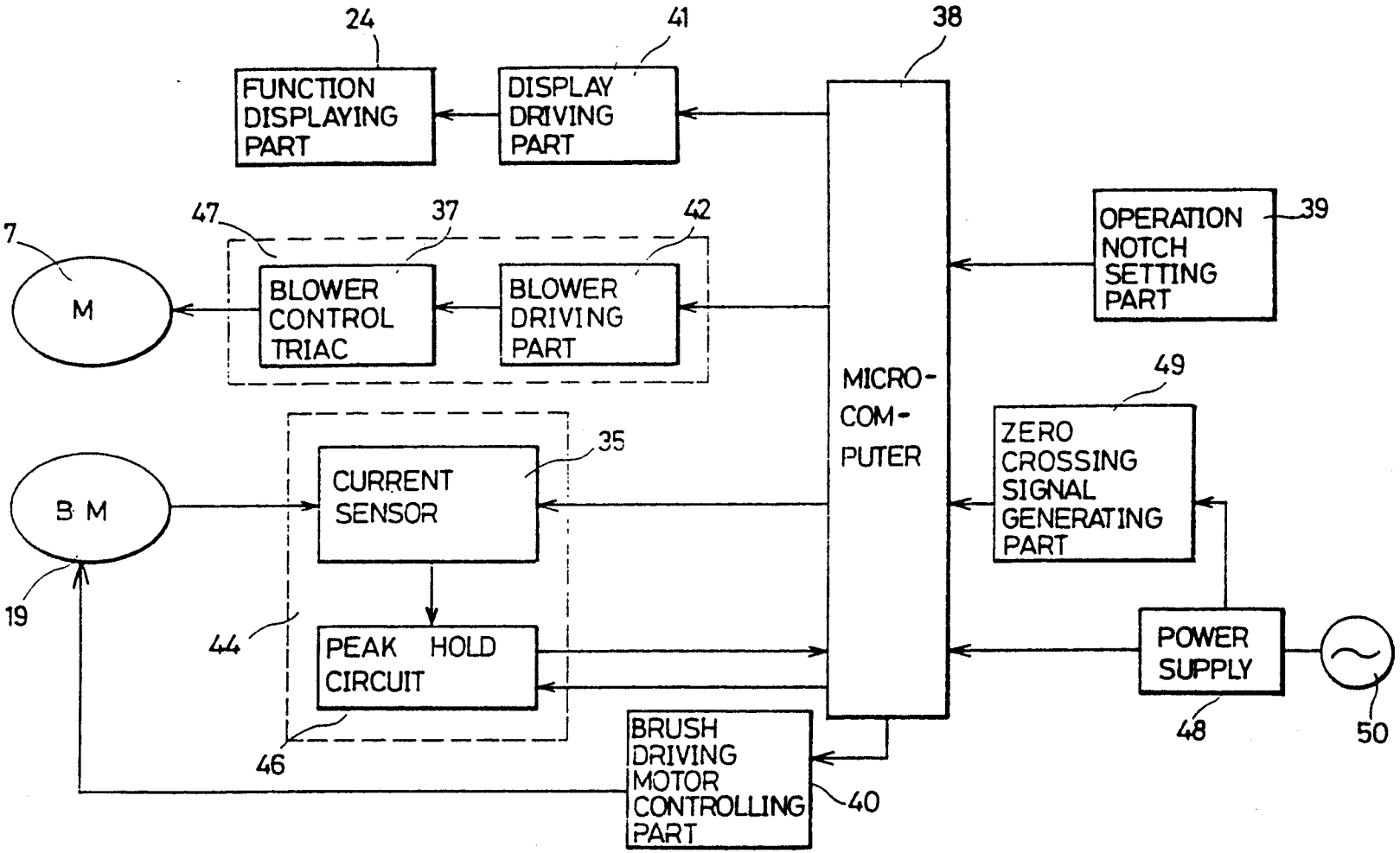
FIG. 6 is a block diagram illustrating a configuration of a control part of an electric vacuum cleaner according to an embodiment of the present invention.

Referring to FIG. 6, a microcomputer 38 includes an arithmetic operation processing part, an input/output part, a memory part, and so forth on one chip arranged on control circuit board 32 illustrated in FIG. 3.

An operation notch controlling part 39, provided in sliding operation part 23 shown in FIG. 4, includes a variable resistor (not shown) in which the position of a slider changes the signal voltage supplied from operation notch setting part 39 39 to microcomputer 38. The position of the slider can be "off", "fuzzy", "weak", "medium", "strong", or "high power". Then microcomputer 38 changes the voltage supplied to electric blower 7 in accordance with the change in the signal voltage.

A display driving part 41 controls the display of function displaying part 24 in response to a signal from microcomputer 38. For example, the states of four light emitting diodes D5–D8 of power control displaying part 27 of function displaying part 24 change to display the control state as directed by the signal from operation notch setting part 39.

A blower driving part 42 directs blower control triac 37 in response to a signal from microcomputer 38, to vary the electric power supplied to electric blower 7. Blower driving part 42 and blower control triac 37 constitute a blower controlling part 47.

A brush driving motor controlling part 40 controls input to brush driving motor 19 in response to a signal from microcomputer 38.

An electric current sensing part 44, which includes electric current sensor 35 a peak hold circuit 46 and senses the current in brush driving motor 19 During cleaning floor nozzle 17 slides back and forth, so the frictional force between the floor surface and dust collecting rotary brush 18 (FIG. 5) changes, and the current in brush driving motor 19 changes accordingly. A load applied to rotary brush 18 changes according to the types of floor surface, for example, whether it is a thick carpet or a thin carpet, whether it is a tatami mat or a board floor and so forth, and the electric current in brush driving motor 19 changes accordingly. Electric current sensor 35 detects such a change in the current in brush driving motor 19 in response to operating conditions of the floor nozzle and the types of floor surface.

A signal detected by electric current sensor 35 has noise removed through a filter (not shown) and then is supplied to peak hold circuit 46 where its peak value is held. The peak value is supplied to microcomputer 38 for every half cycle or full cycle of the power supply. Then, if supply of the peak value to microcomputer 38 is ended, peak hold circuit 46 is reset, and the next current sensing operation is performed.

A commercial power supply 50 is connected through a power supply part 48 to microcomputer 38. A zero crossing signal generating part 49 generates a zero crossing signal an output of power supply part 48 and supplies it to microcomputer 38. As described below, the zero crossing signal is used to control blower control triac 37 and to detect the peak value of the current by electric current sensing part 44.

Referring to FIGS. 7 to 9, FIGS. 7A to 7E show waveforms of the electric current in brush driving motor 19 where no load exits for floor nozzle 17 (FIG. 7 and 7A'), where a board floor is cleaned (FIG. 7B), where a thin carpet is cleaned (FIG 7C), where a carpet with medium thickness is cleaned (FIG. 7D), and where a thick carpet is cleaned (FIG. 7E), respectively. In each of FIGS. 7A–7E, one unit of the abscissa indicates 200 m seconds.

Figures 1, 7A:
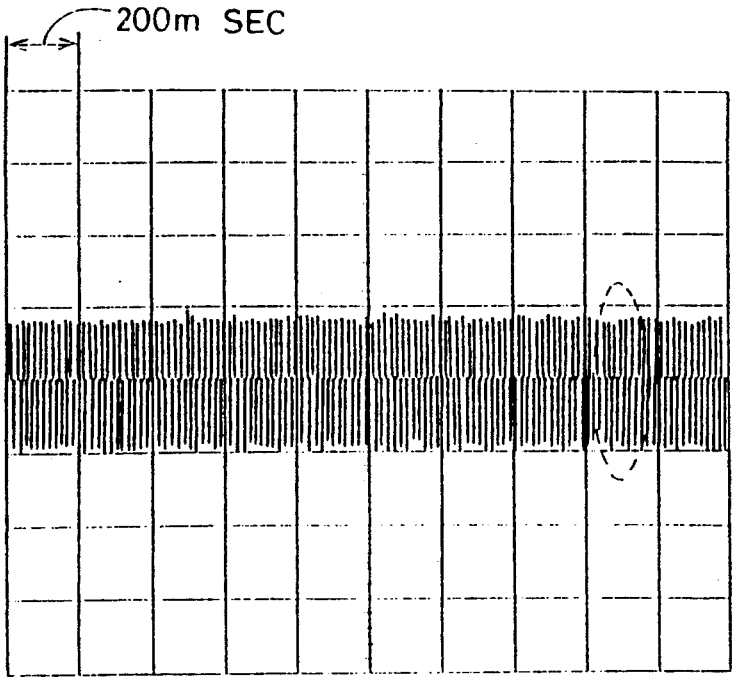
FIGS. 7A to 7E are diagrams illustrating electric current waveforms of a brush driving motor for various loads according to an embodiment of the present invention.
Figures 2, 7A:
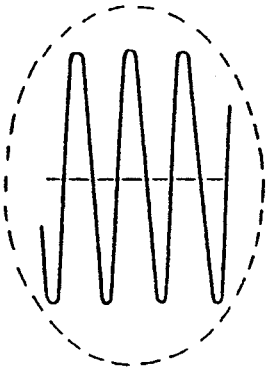
Figure 7B:
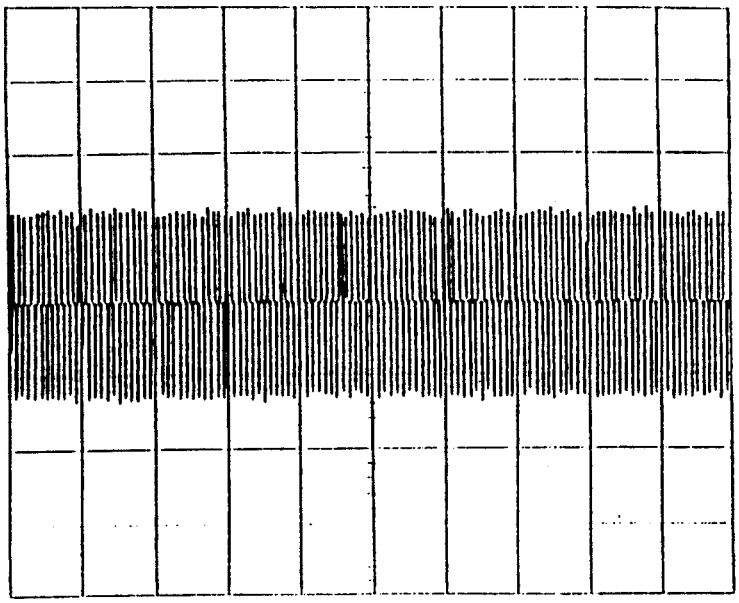
Figure 7C:
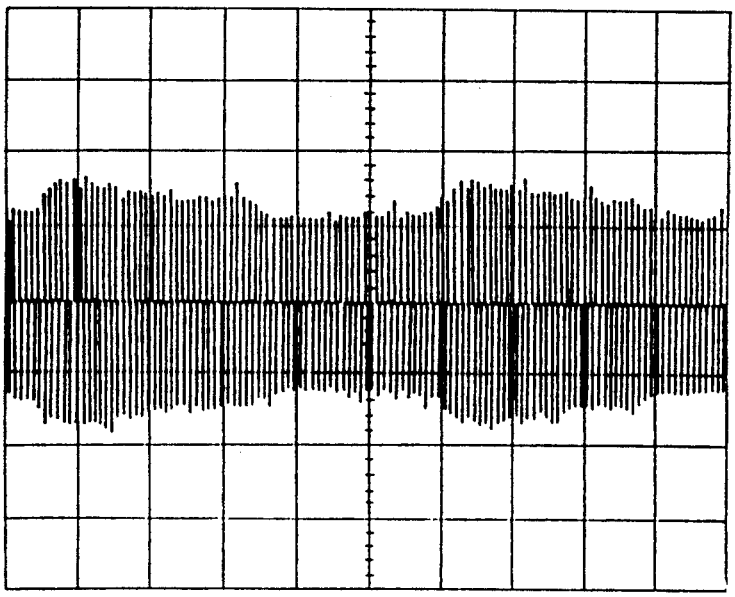
Figure 7D:
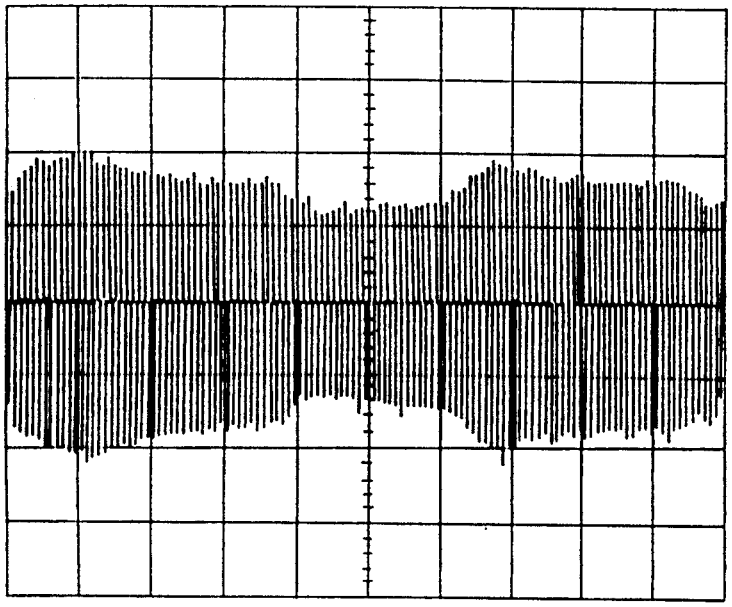
Figure 7E:
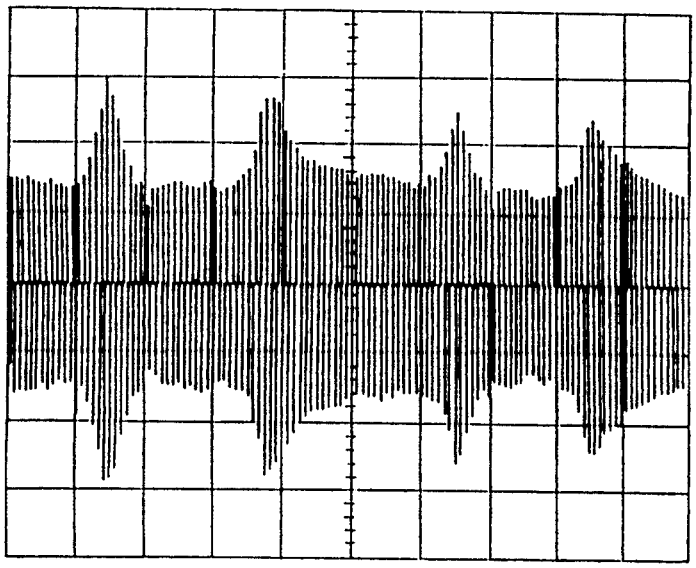

Referring to FIG. 7E, it can be seen that, where a carpet is cleaned by moving floor nozzle 17 back and forth, the brush driving motor 19 is highest when the operation turns from pulling (moving backward) to pushing (moving forward), and the second largest current flows when the operation turns from pushing (moving forward) to pulling (moving backward). When floor nozzle 17 is moved in one direction, the current in brush driving motor 19 is almost constant regardless of the thickness of the carpet.

Accordingly, in an embodiment of the present invention, in view of the waveforms illustrated in FIGS. 7A to 7E, electric current sensor 35 senses the motion of floor nozzle 17. Specifically, a peak value of the current in brush driving motor 19 is determined for every half cycle or full cycle of the power supply frequency. The maximum of the so-determined peak values is determined time interval T between adjacent maxima values is evaluated, and the motion of floor nozzle 17 is determined from T. Furthermore, the maximum peak value is determined for an appropriate time period (0.5 seconds in this embodiment, for example) a little shorter than the average time period required by one back and forth stroke of floor nozzle 17, and the type of the floor surface is also determined from the maximum value.

Figure 8:
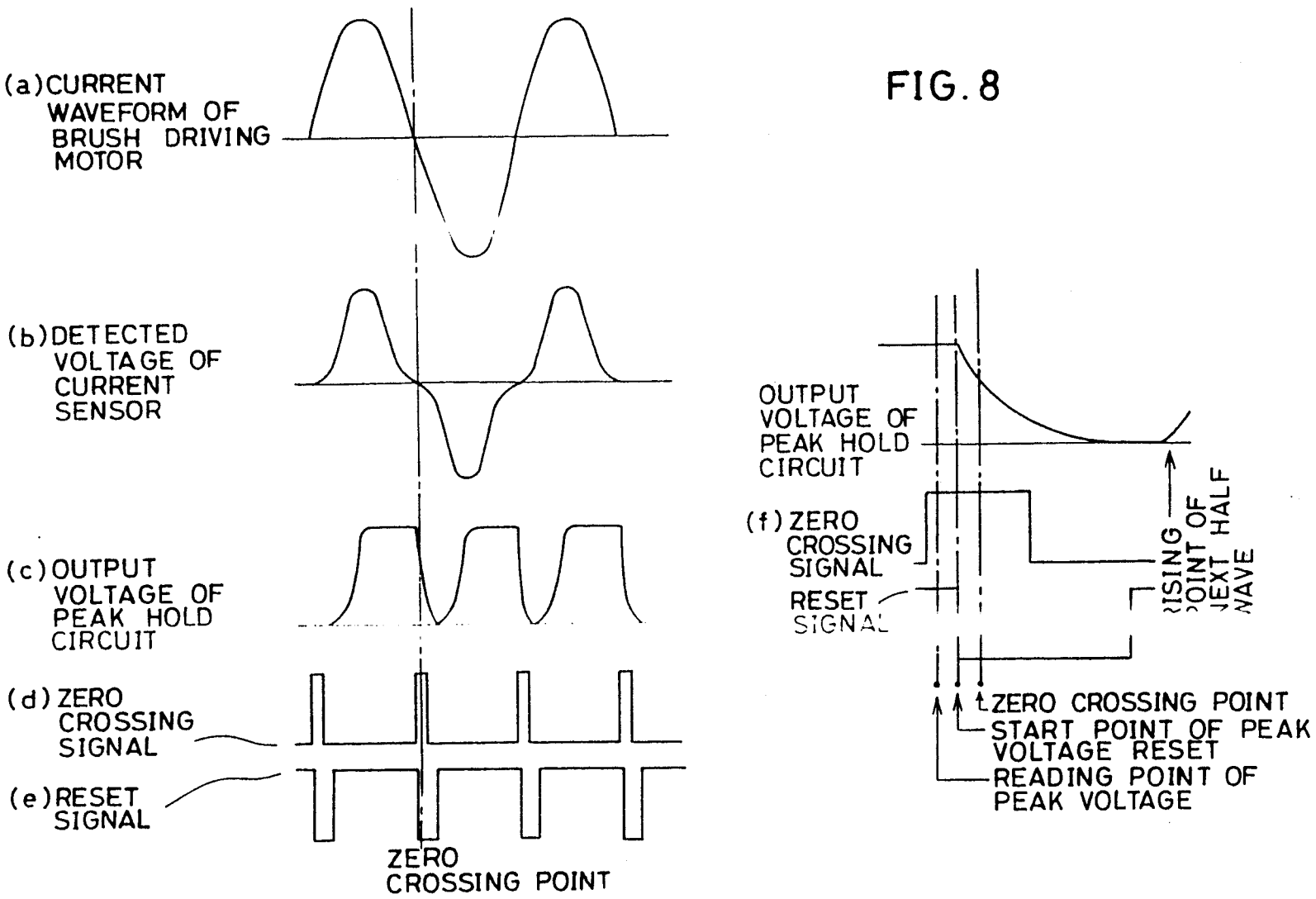
FIG. 8 is a timing chart illustrating how a peak current value of a brush driving motor is determined according to an embodiment of the present invention.

Next, FIGS. 8(*a*)–(*e*) show waveforms of electric current or voltage in each part of electric current sensing part 44 illustrated in FIG. 6. FIG. 8(*f*) is an enlarged waveform diagram illustrating the relations among FIGS. 8(*c*), 8(*d*) and 8(*e*). Specifically, electric current sensor 35 in electric current detecting part 44 determined the current (FIG. 8(*a*)) in brush driving motor 19 and supplies a corresponding voltage (FIG. 8(*b*)) to peak hold circuit 46. Peak hold circuit 46 supplies a peak value (FIG. 8(*c*)) of the voltage to microcomputer 38 in synchronism with a zero crossing signal (FIG. 8(*d*)) from microcomputer 38. The zero crossing signal is a pulse of constant duration centered at the zero crossing point of the supply voltage waveform (FIG. 8(*f*)). After the peak value is supplied to microcomputer 38, the peak value held in peak hold circuit 46 is reset in synchronism with a reset signal (FIG. 8(*e*)) from microcomputer 38. As illustrated in FIG. 8(*f*), the reset signal is a pulse that falls a constant time later than the rise of the zero crossing signal.

Referring to FIG. 9, an arithmetic operation is performed by microcomputer 38 on an output of peak hold circuit 46.

Figure 9A:
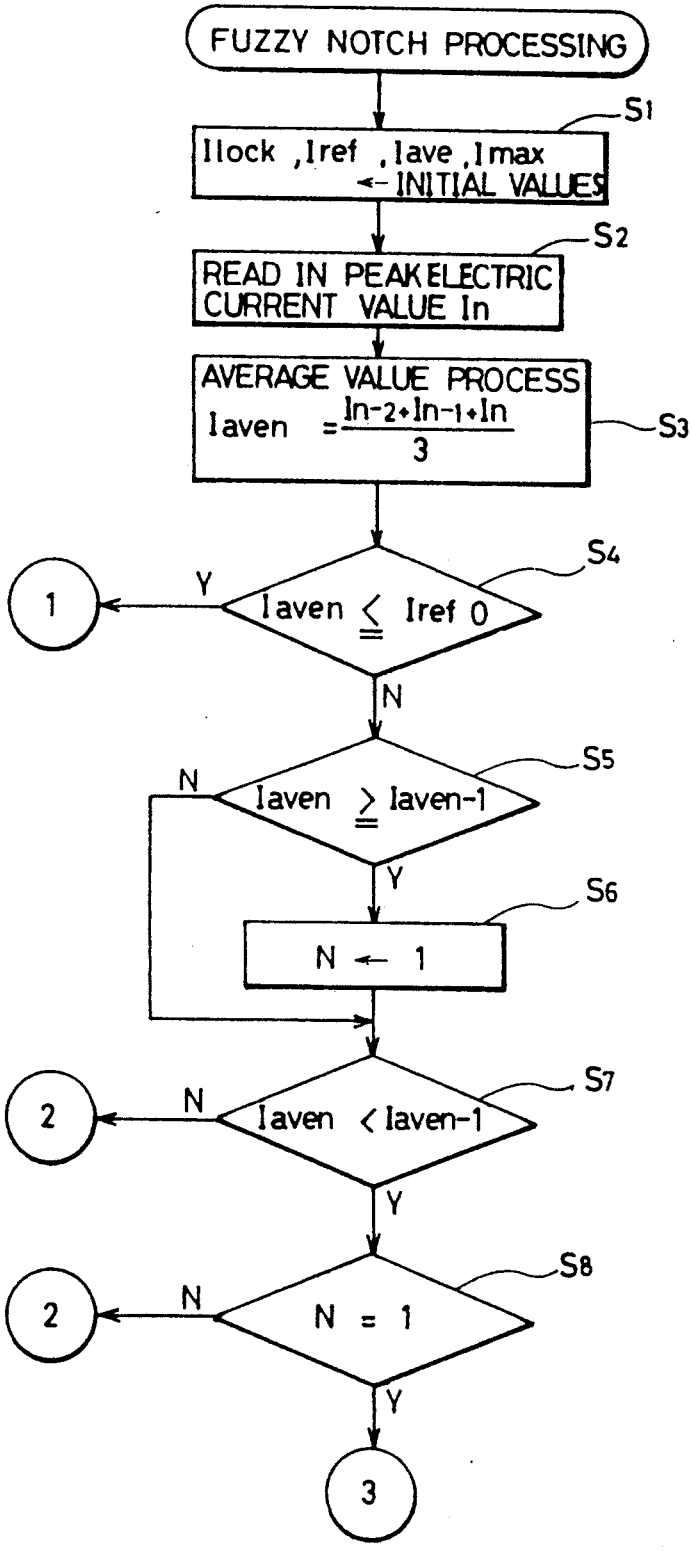
FIGS. 9A to 9D are flow charts illustrating the control of an electric blower according to an embodiment of the present invention.

First, referring to FIG. 9A, if sliding operation part 23 of operation notch setting part 39 (FIG. 6) is set to the fuzzy control position (fuzzy), initial values corresponding to average value $I_{ave}$, the maximal value $I_{max}$ of the electric current in brush driving motor 19, the motor current $I_{lock}$ where brush driving motor 19 is locked, and the reference current $I_{ref}$, respectively, are substituted (step S1).

Next, the peak value $I_n$ (represented as a detected voltage of peak hold circuit 46) for every half cycle of the current in brush driving motor 19 is read from peak hold circuit 46 (step S2), and an average value $I_{aven}$ of $I_n$, a peak value $I_{n-1}$ in the last half cycle, and a peak value $I_{n-2}$ in a half cycle before the last half cycle is evaluated and substituted for the average value $I_{ave}$ (step S3).

Where brush driving motor 19 is stopped or floor nozzle 17 falls away from extension pipe 20 a reference current is set to $I_{ref0}$ and compared (step S4) to the average value $I_{aven}$ evaluated in step S3. If $I_{aven} \geqq I_{ref0}$, rotation of brush driving motor 19 has stopped. The program jumps to ① in FIG. 9C, makes $I_a$ be 0 as will be described later, stops driving brush driving motor 19, and returns to a main routine.

On the other hand, $I_{aven} > I_{ref0}$, the average current $I_{aven}$ at the present time is compared with the previous average current $I_{aven-1}$ (step S5). If $I_{aven} \geqq I_{aven-1}$, it the peak current in brush driving motor 19 is increasing, and a flag of N=1 is set (step S6). Then the program jumps to ② in FIG. 9C through step S7.

If $I_{aven} < I_{aven-1}$, the program proceeds through steps S5 to S7 to step S8, and it checks whether flag N=1 is set. If N=1, i.e., current had been increasing the peak current is now changing from rising to falling, and the program jumps to ③ (a comparison routine) in FIG. 9B. In other cases, it jumps to ② in FIG. 9C.

Figure 9B:
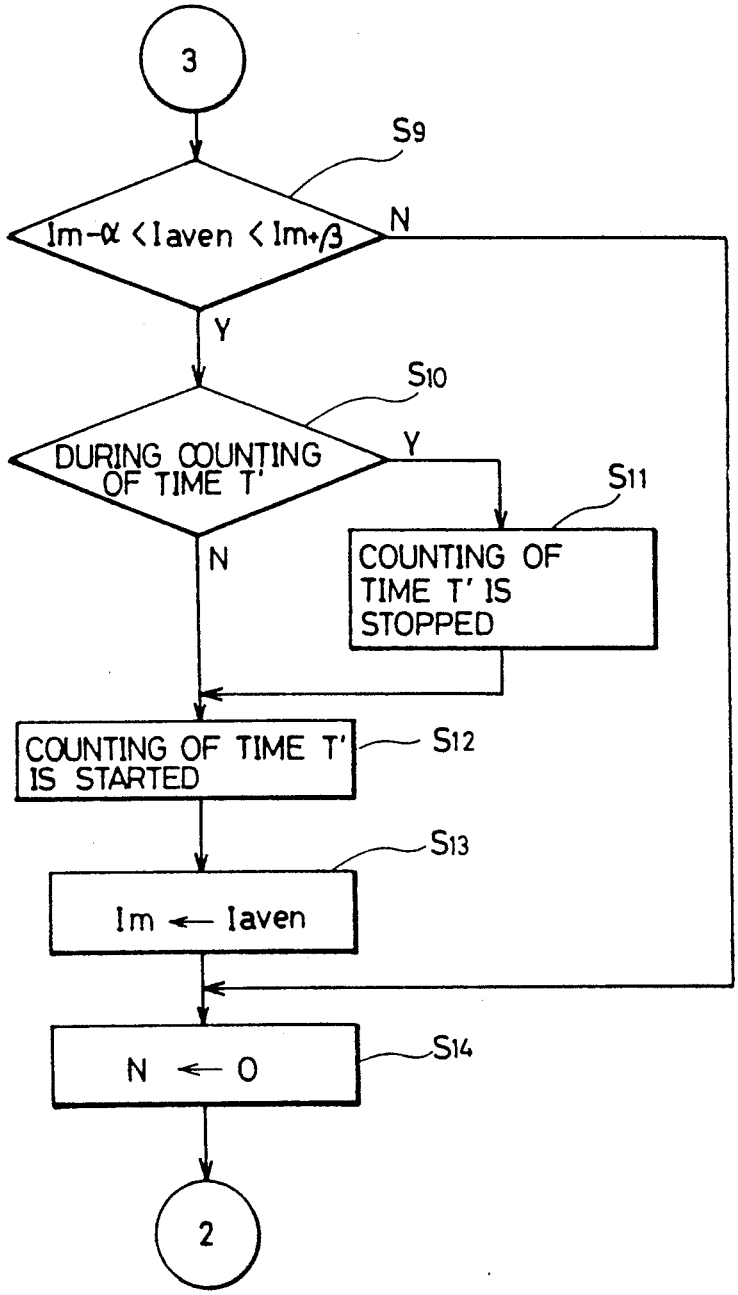

Referring to FIG. 9B, it is determined whether or not the present average current $I_{aven}$ at the turning point from rising to falling satisfies the relation $I_m - \alpha < I_{aven} < I_m + \beta$ for the maximum $I_m$ determined previously or not (step S9). When this relation is satisfied, counting the interval started simultaneously with determining the previous maximum $I_m$ is stopped (steps S10 and S11), a measured time T' is substituted for an interval T between adjacent maxima values (step S11), and counting a new interval T is started (step S12). $I_{aven}$ is substituted as the present maximum for $I_m$ until the next maxima is determined (step S13). The program jumps to ② in FIG. 9C with the flag N set to N=0 in order to show that the average current is falling.

Where the relation $I_m - \alpha < I_{aven} < I_m + \beta$ is not satisfied in step S9, the program determines that this $I_{aven}$ is not the maximum, jumps to step S14, and sets the flag N to N=0.

Figure 9C:
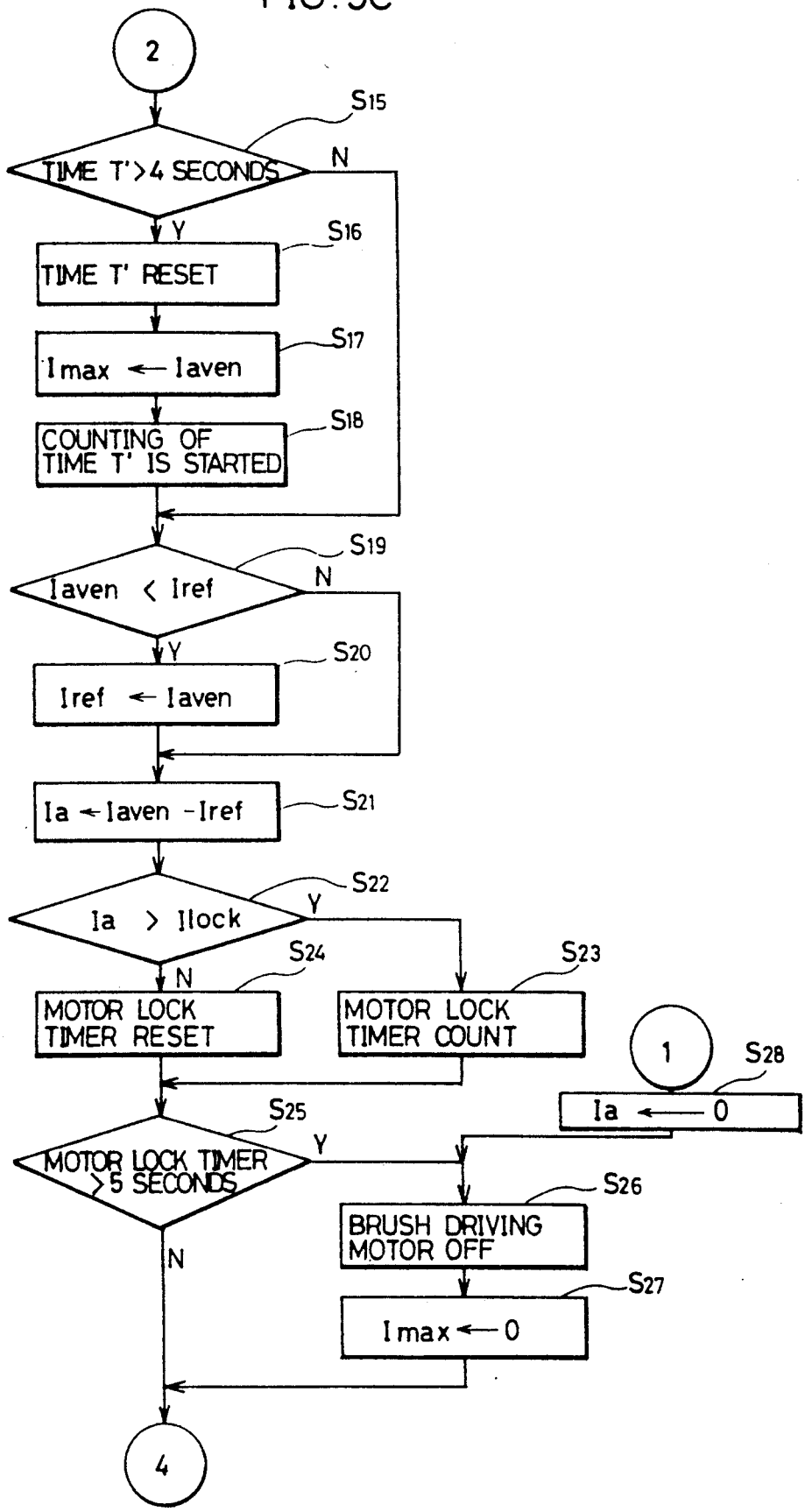

Referring to FIG. 9C, if the time T' exceeds 4 seconds (step S15), implying no cleaning now, the counter is reset (step S16), the maximum $I_m$ is changed to the present $I_{aven}$ (step S17), and counting of an interval T is started again (step S18).

Figure 10:
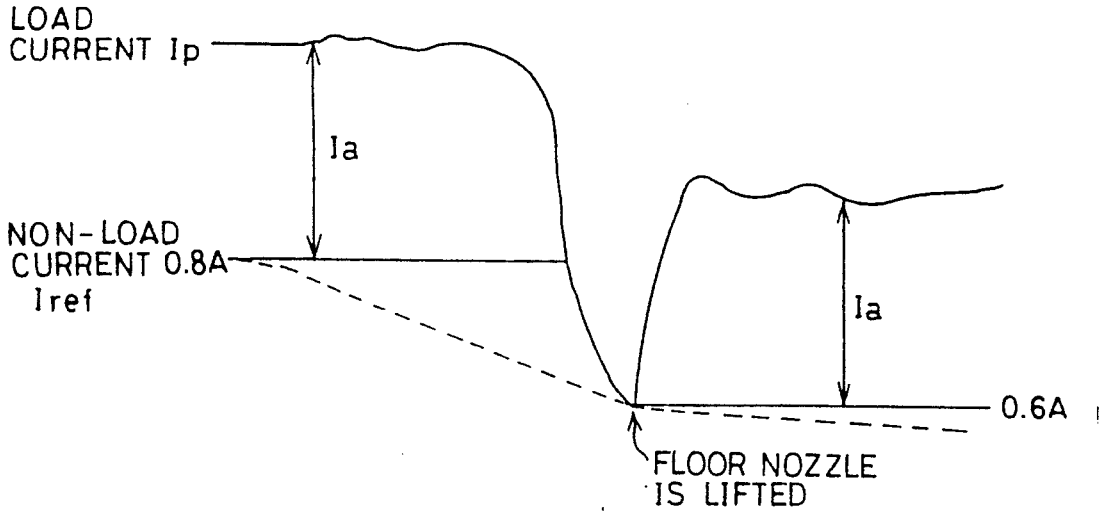
FIG. 10 is a waveform diagram to supplement the description of the control operation illustrated in FIG. 9.

Then the present electric current average value $I_{aven}$ is compared to a reference value $I_{ref}$ (step S19). As illustrated in FIG. 10, $I_{ref}$ is an initial value (0.8A, for example) of the current in brush driving motor 19 in a no-load state stored in advance in memory of microcomputer 38. The no-load current gradually decreases as the temperature of brush driving motor 19 rises, as indicated by a broken line in FIG. 10. Accordingly, in order to find the current in brush driving motor 19, it is necessary to find the difference between a detected load current and a variable actual no-load current. To find the variable noload current value, if the no-load current in brush driving motor 19 becomes $I_{ref}$=0.8A or less (0.6A, for example), the moment floor nozzle 17 is lifted, for example, the current may be become a new comparison reference value $I_{ref}$. Therefore, when the current $I_{aven}$ is smaller than the reference current $I_{ref}$ in step S19 in FIG. 9C, $I_{aven}$ is substituted for $I_{ref}$ (step S20). Thus, before changing $I_{ref}$, the difference $I_a = I_{aven} - I_{ref}$ between the load current value $I_{aven}$ and the initial comparison reference value $I_{ref}$(0.8A) is evaluated as real load current (step S21). After changing $I_{ref}$, the difference $I_a = I_{aven} - I_{ref}$ between the load current $I_{aven}$ and the reference current $I_{ref}$ after updating (0.6A) is evaluated as a real load current (step S21).

Next, real load current $I_a$ is compared to the current in brush driving motor 19 where the brush is locked, i.e. the current $I_{lock}$ where a piece of cloth or the like clings to rotary brush 18 to stop rotation of the brush, which is stored in memory of microcomputer 38 (step S22). Where the load current $I_a$ is larger than the current $I_{lock}$, a motor lock timer (not shown) contained in microcomputer 38 starts to count (step S23) to determine whether rotary brush 18 is actually locked or not. Where $I_a$ is larger than $I_{lock}$ even when the motor lock timer reaches or exceeds a predetermined value (5 seconds, for example) (step S25), it is concluded that rotary brush 18 is actually locked, the supply of current to brush driving motor 19 is stopped to prevent its burnout (step S26), and the value $I_{max}$ is set to 0 (step S27). where the load current $I_a$ is smaller than the current $I_{lock}$ from the beginning or becomes smaller during counting by the motor lock timer, it is concluded that rotary brush 18 is not locked, the motor lock timer is reset (step S24), and the program jumps to ④ in FIG. 9D.

Figure 9D:
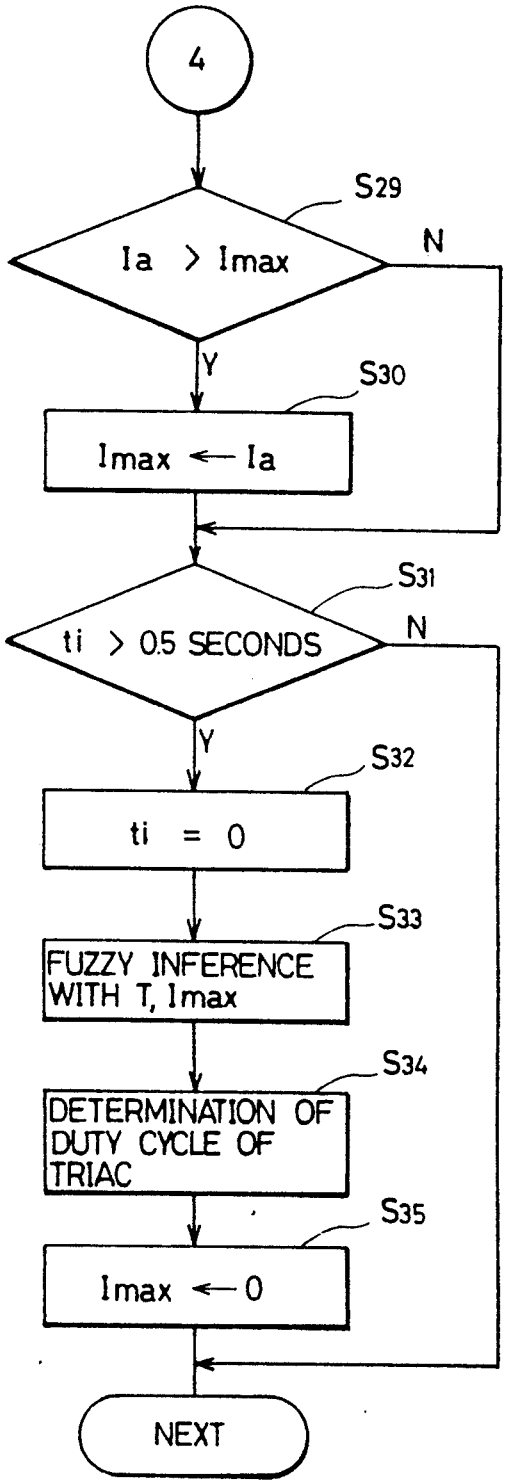

Referring to FIG. 9D, $I_a$ and $I_{max}$ are compared in step S29. If $I_a$ is $I_{max}$ or more, $I_{max}$ is updated to $I_a$ (step S30). Then, every time 0.5 seconds is counted by a counter not shown (steps S31 and S32), a duty cycle of blower control triac 37 is determined from the present interval T, the maximum value $I_{max}$, and a look up table, illustrated in FIG. 11, which is stored in advance in microcomputer 38 (steps S33 and S34), to control electric blower 7. At the same time, 0 is substituted for $I_{max}$ (step S35).

Fuzzy inference is employed to control input to electric blower 7, in which information with a fuzzy boundary is processed. More specifically, the result of performing a fuzzy inference procedure in steps S33 and S34 in FIG. 9D is shown in the look up table (FIG. 11). In the fuzzy inference procedure, the following production rules are used.

[Rule 1]

If the current $I_{max}$ is large and the time T is about medium, then the input is large.

[Rule 2]

If the current $I_{max}$ is about medium and the time T is somewhat short, then the input is somewhat large.

[Rule 3]

If the current $I_{max}$ is about medium and the time T is somewhat long, then the input is somewhat large.

[Rule 4]

If the current $I_{max}$ is somewhat small and the time T is about medium, then the input is about medium.

[Rule 5]

If the current $I_{max}$ is somewhat small and the time T is long, then the input is small.

[Rule 6]

If the current $I_{max}$ is small, then the input is small.

[Rule 7]

If the current $I_{max}$ is very small, then the input is about medium.

Figure 12:
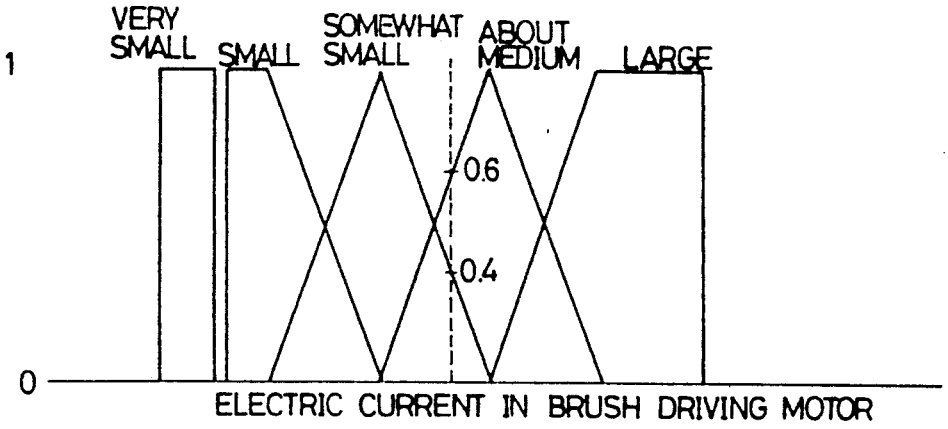
FIGS. 12 and 13 are graphs illustrating membership functions for input variables according to an embodiment of the present invention.
Figure 13:
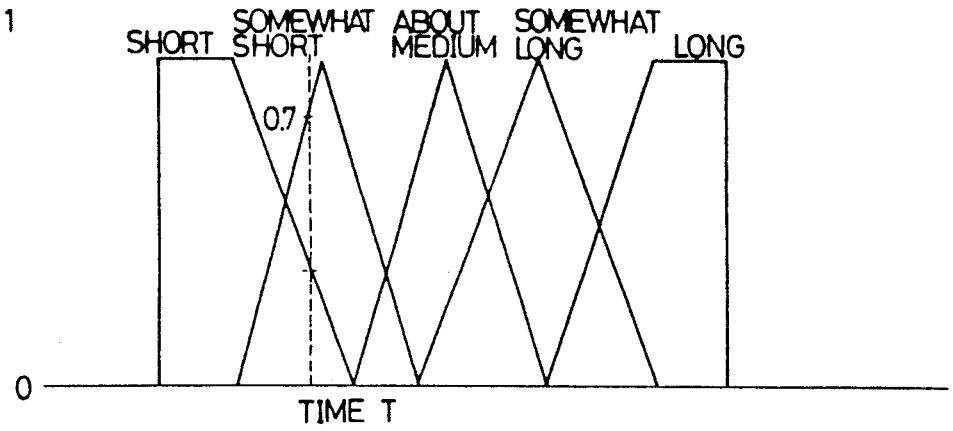
Figure 14:
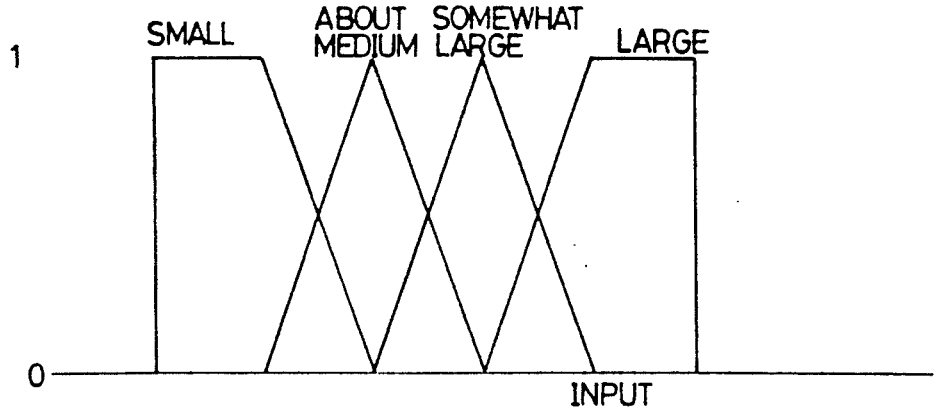
FIG. 14 is a graph illustrating a membership function for a conclusion part according to an embodiment of the present invention.

In these rules, as illustrated in FIGS. 12 and 13, the conditions such as "large" and "small" are defined by membership functions for current $I_{max}$ of brush driving motor 19 that changes with the condition of the floor surface and the force pressing floor nozzle 17 against the floor surface and interval T between maxima of the current that changes with the speed of movement of floor nozzle 17 on the floor surface. The conclusion part is the duty cycle of blower control triac 43 defined by the membership function illustrated in FIG. 14. The inference is performed by a MAX-MIN synthesis method, and the conclusion is determined by a centroid method (defuzzifier processing).

Each of the above-described rules will now be described.

Figures 15A, 15B, 15C, 16A, 16B, 16C:
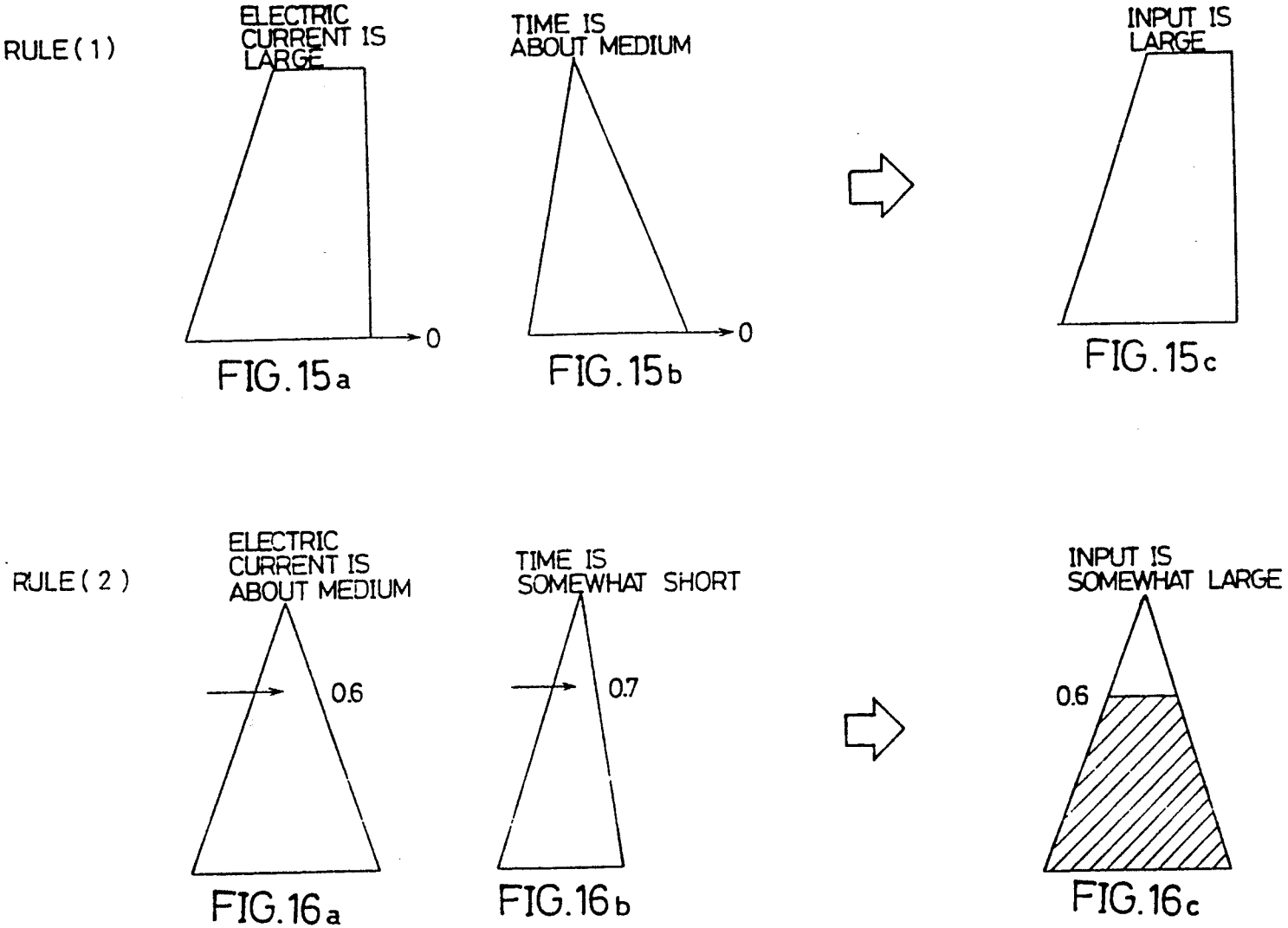
FIG. 15 is a graph illustrating a membership function of rule 1 of an embodiment of the present invention.
FIG. 16 is a graph illustrating a membership function of rule 2 of an embodiment of the present invention.

[Rule 1] is defined by such membership functions as are shown in FIGS. 15(*a*), (*b*) and (*c*). FIG. 15(*a*) is a graph for finding a membership value indicating the degree of satisfaction of the first condition, "the electric current $I_{max}$ is large", of Rule 1, which indicates a membership function for the current $I_{max}$. A membership (0, for example) is found by substituting the current $I_{max}$ in this membership function as illustrated in FIG. 12.

FIG. 15(*b*) is a graph for finding a membership value indicating the degree of satisfaction of the second condition, "the time T is about medium", of Rule 1, which indicates a membership function for the time T. A membership value (0, for example) is found by substituting the time T in this membership function as illustrated in FIG. 13.

FIG. 15(*c*) is a graph showing the conclusion, "the input is made large", which indicates a membership function for the duty cycle of the blower control triac as the conclusion part of Rule 1. The smaller value (0) of the membership values of the first and second conditions of Rule 1 is specified on the ordinate to indicate the membership value of FIG. 15(*c*). A region indicated by the membership function of FIG. 15(*c*) is divided into two areas by a line corresponding the specified membership value (0), and a region which does not exceed the membership value corresponds to an inference result obtained by applying each of the determined values to Rule 1.

[Rule 2] is defined by such membership functions as are shown in FIGS. 16(*a*), (*b*) and (*c*). FIG. 16(*a*) is a graph for finding a membership value indicating the degree of satisfaction of the first condition, "the current $I_{max}$ is about medium", of Rule 2, which indicates a membership function for the current $I_{max}$. A membership (0.6, for example) is found by substituting the current $I_{max}$ in this membership function.

FIG. 16(*b*) is a graph for finding a membership value indicating the degree of satisfaction of the second condition, "the time T is somewhat short", of Rule 2, which indicates a membership function for the time T. A membership value (0.7, for example) is found by substituting the time T in this membership function.

FIG. 16(*c*) is a graph showing the conclusion, "the input is made somewhat large", which indicates a membership function for the duty cycle of the blower control triac 37 as the conclusion part of Rule 2. The smaller value (0.6) of the membership values of the first and second conditions of Rule 2 is specified on the ordinate to indicate the membership value of FIG. 16(*c*). A region indicated by the membership function of FIG. 16(*c*) is divided into two areas by a line corresponding to the specified membership value (0.6), and a region indicated by oblique lines which does not exceed the membership value corresponds to an inference result obtained by applying each of the determined values to Rule 2.

[Rule 3] is defined by such membership functions as are illustrated in FIGS. 17(*a*), (*b*) and (*c*). FIG. 17(*a*) is a graph for finding a membership value indicating the degree of satisfaction of the first condition, "the current $I_{max}$ is about medium", of Rule 3, which indicates a membership function for the current $I_{max}$. A membership value (0.6, for example) is found by substituting the current $I_{max}$ in this membership function FIG. 17(*b*) is a graph for finding a membership value indicating the degree of satisfaction of the second condition, "the time T is somewhat long", of Rule 3, which indicates a membership function for the time T. A membership value (0, for example) is found by substituting the time T in this membership function.

Figures 17A, 17B, 17C:
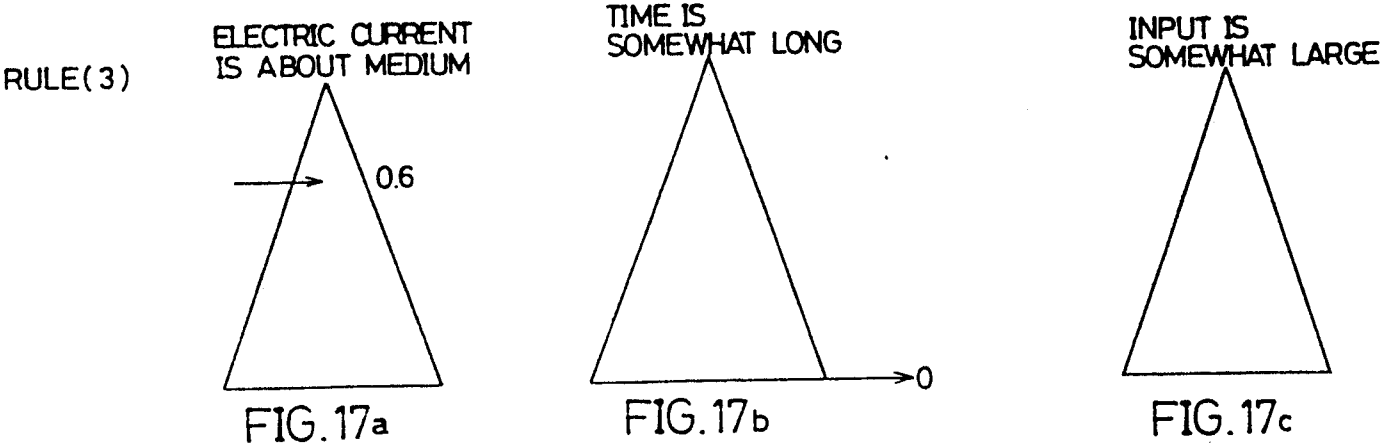
FIG. 17 is a graph illustrating a membership function of rule 3 of an embodiment of the present invention.

FIG. 17(*c*) is a graph showing the conclusion, "the input is made somewhat large", which indicates a membership function for the duty cycle of the blower control triac 37 as the conclusion part of Rule 3. The smaller value (0) of the membership values of the first and second conditions of Rule 3 is specified on the ordinate indicating the membership value of FIG. 17(*c*). A region indicated by the membership function of FIG. 17(c) is divided into two areas by a line corresponding to the specified membership value (0), and a region which does not exceed the membership value corresponds to an inference result obtained by applying each of the determined values to Rule 3.

[Rule 4] is defined by such membership functions as shown in FIGS. 18(*a*), (*b*) and (*c*). FIG. 18(*a*) is a graph for finding a membership value indicating the degree of satisfaction of the first condition, "the current $I_{max}$ is somewhat small", of Rule 4, which indicates a membership function for the current $I_{max}$. A membership value (0.4, for example) is found by substituting the electric current value $I_{max}$ in this membership function FIG. 18(*b*) is a graph for finding a membership value indicating the degree of satisfaction of the second condition, "the time T is about medium", of Rule 4, which indicates a membership function for the time T. A membership value (0, for example) is found by substituting the time T in this membership function.

Figures 18A, 18B, 18C:
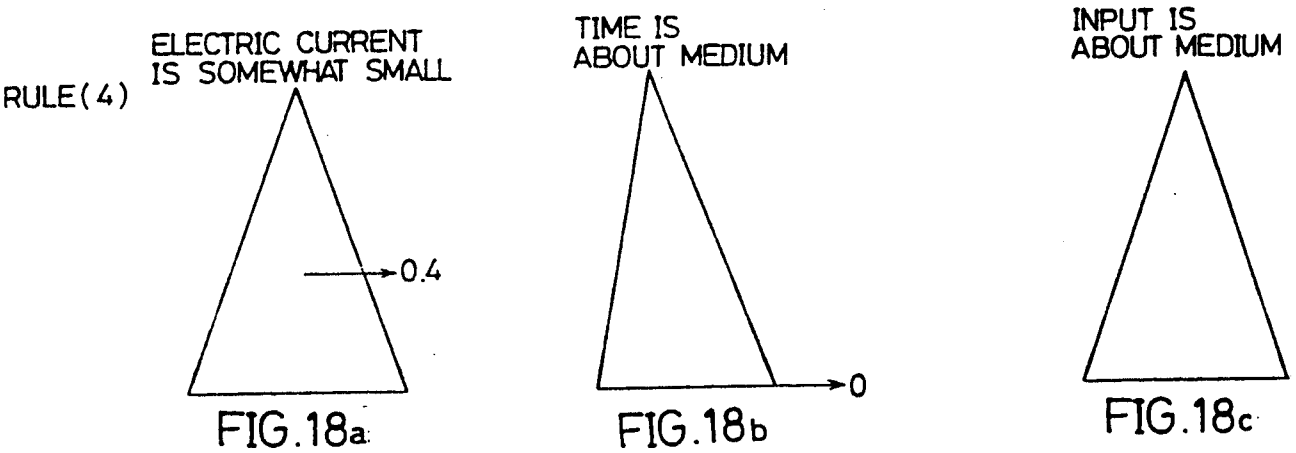
FIG. 18 is a graph illustrating a membership function of rule 4 of an embodiment of the present invention.

FIG. 18(*c*) is a graph showing the conclusion, "the input is made about medium", which indicates a membership function for the duty cycle of the blower control triac 37 as the conclusion part of Rule 4. The smaller value (0) of the membership values of the first and second conditions of Rule 4 is specified on the ordinate indicating the membership value of FIG. 18(c). A region indicated by the membership function of FIG. 18(c) is divided into two areas by a line corresponding to the specified membership value (0), and a region which does not exceed the membership value corresponds to an inference result obtained by applying each of the determined values to Rule 4.

Figure 19A:
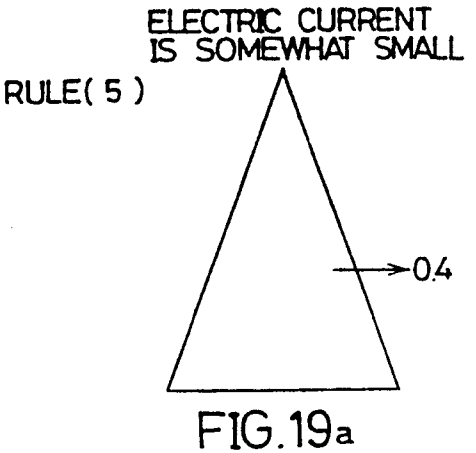
FIG. 19 is a graph illustrating a membership function of rule 5 of an embodiment of the present invention.

[Rule 5] is defined by such membership functions as are shown in FIGS. 19(a), (b) and (c). FIG. 19(a) is a graph for finding a membership value indicating the degree of satisfaction of the first condition, "the current $I_{max}$ is somewhat small", of Rule 5, which indicates a membership function for the current $I_{max}$. A membership value (0.4, for example) is found by substituting the current $I_{max}$ in this membership function.

Figure 19B:
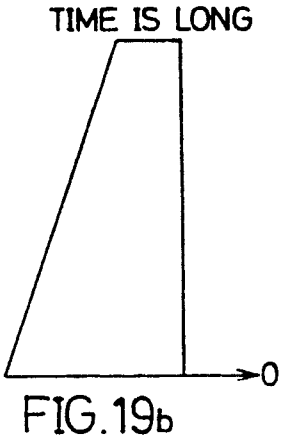

FIG. 19(b) is a graph for finding a membership value indicating the degree of satisfaction of the second condition, "the time T is long", of Rule 5, which indicates a membership function for the time T. A membership value (0, for example) is found by substituting the time T in this membership function.

Figure 19C:
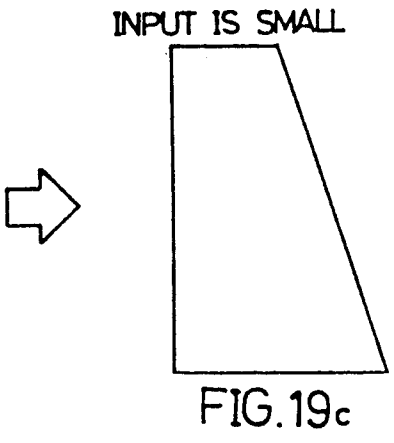

FIG. 19(c) is a graph showing the conclusion, "the input is made small", which indicates a membership function for the duty cycle of the blower control triac 37 as the conclusion part of Rule 5. The smaller value (0) of the membership values of the first and second conditions of Rule 5 is specified on the ordinate indicating the membership value of FIG. 19(c). A region indicated by the membership function of FIG. 19(c) is divided into two areas by a line corresponding to the specified membership value (0), and a region which does not exceed the membership value corresponds to an inference result obtained by applying each of the determined values to Rule 5.

Figure 20A:
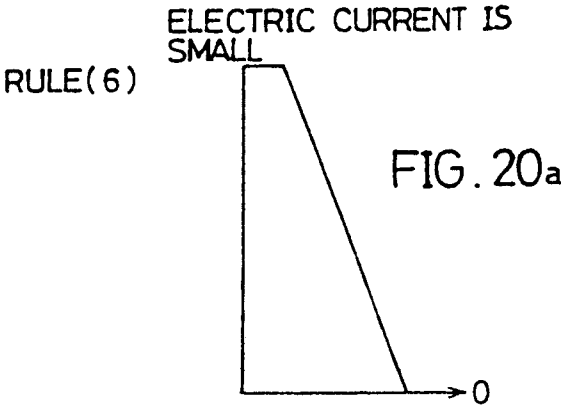
FIG. 20 is a graph illustrating a membership function of rule 6 of an embodiment of the present invention.

[Rule 6] is defined by such membership functions as are shown by FIGS. 20(a) and (b). FIG. 20(a) is a graph for finding a membership value indicating the degree of satisfaction of the condition, "the current $I_{max}$ is small", of Rule 6, which indicates a membership function for the current $I_{max}$. A membership value 0 is found by substituting the electric current value $I_{max}$ in this membership function.

Figure 20B:
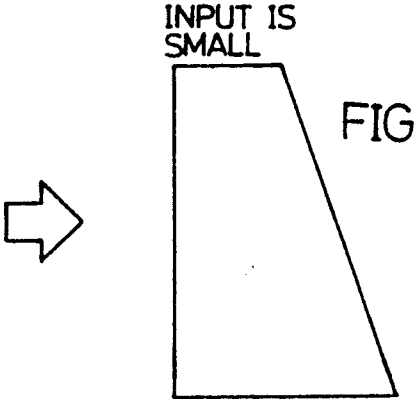

FIG. 20(b) is a membership function showing the conclusion, "the input is made small", and the membership value of 0 of the condition is specified on its ordinate. A region which does not exceed the membership value 0 corresponds to an inference result obtained by applying an actual value to Rule 6.

Figures 21A, 21B, 22:
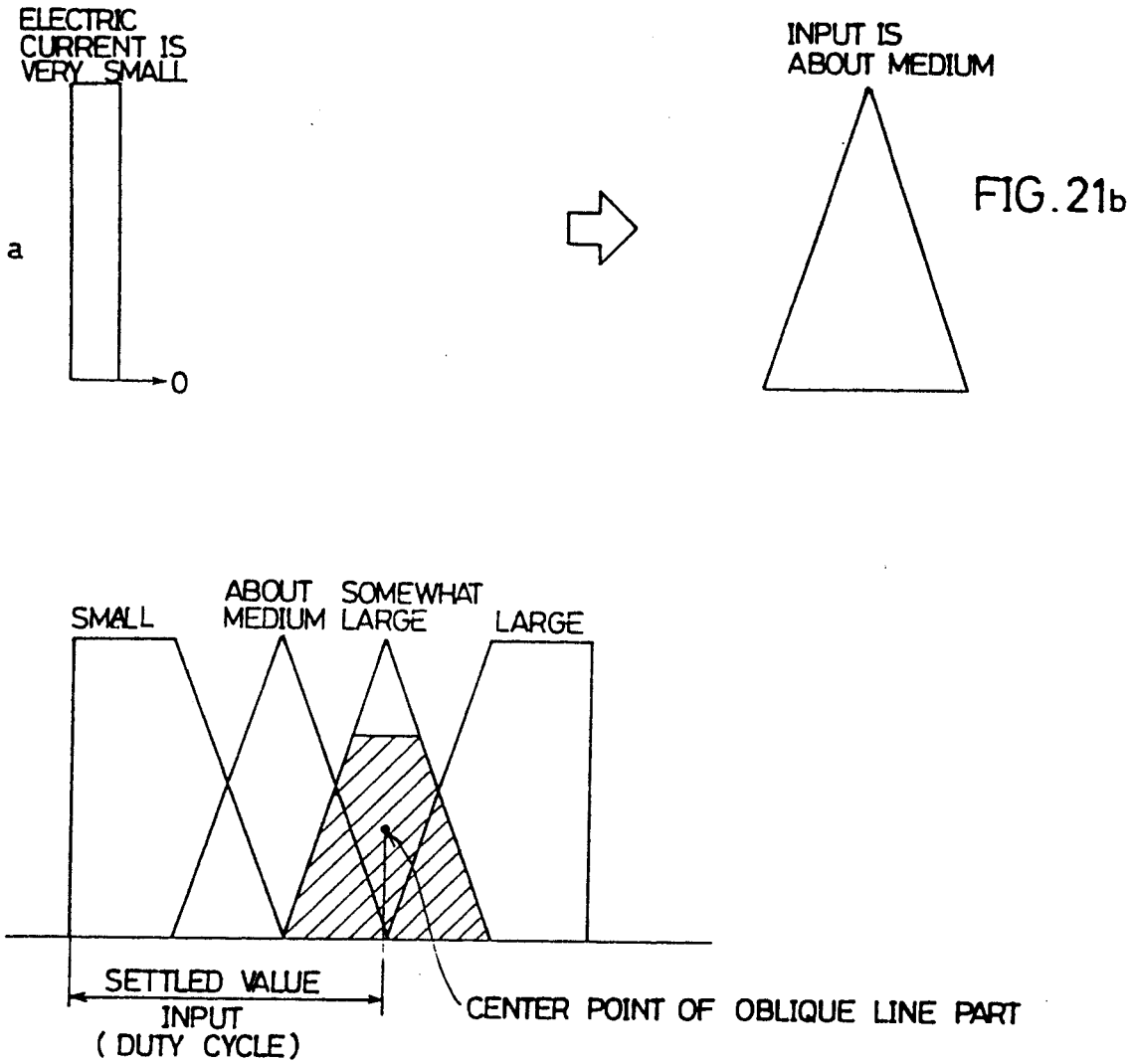
FIG. 22 is a graph illustrating the evaluation of an inference result according to an embodiment of the present invention.

[Rule 7] is defined by such membership functions as are shown in FIGS. 21(a) and (b). FIG. 21(a) is a graph for finding a membership value indicating the degree of satisfaction of the condition, "the current $I_{max}$ is very small", of Rule 7, which indicates a membership function for the current $I_{max}$. A membership value of 0 is found by substituting the current $I_{max}$ in this membership function.

FIG. 21(b) is a membership function showing the conclusion, "the input is made about medium", and the membership value of 0 of the condition is specified on its ordinate. A region which does not exceed the membership value of 0 corresponds to an inference result obtained by applying an actual value to Rule 7. Referring to FIG. 22, a method of determining the duty cycle of the blower control triac 37 requires that the quadrangle indicated by oblique lines in FIG. 16(c) be superimposed on the coordinate system of FIG. 14. A function of FIG. 22 obtained as a result of this superimposition corresponds to a membership function showing the final inference result. The position of the center point of the region indicated by oblique lines is settled as the duty cycle of the blower control triac 37 determined from all the conditions of Rules 1 to 7.

A result obtained by performing the fuzzy inference procedure as described above on all possible values of $I_{max}$ and time T is represented in the look up table in FIG. 11.

Next, the effects of the above-described respective rules on the input control operation of the electric blower will be described.

According to [Rule 1], where "the current $I_{max}$ is large" and "the time T is about medium", a carpet (a shaggy carpet, for example) which is thick (more than 2 more) is being cleaned with floor nozzle 17 pushed and pulled at an ordinary speed, so that the current to the electric blower 7 is large to suck dust collected deep in the carpet.

According to [Rule 2], where "the electric current $I_{max}$ is about medium" and "the time T is somewhat short", a carpet with a medium thickness or a loop carpet is being cleaned with floor nozzle 17 pushed and pulled at a somewhat high speed, so that the input to the electric blower is controlled to be somewhat large in order to leave no dust in considering the thickness of the carpet.

According to [Rule 3], where "the electric current $I_{max}$ is about medium" and "the time T is somewhat long", it is considered that a carpet with a medium thickness or a loop carpet is being cleaned with floor nozzle 17 pushed and pulled at a somewhat low speed, so that the current to the electric blower 7 is somewhat large order toe leave no dust in considering of the thickness of the carpet.

According to [Rule 4], where "the current $I_{max}$ is somewhat small" and "the time T is about medium", a thin carpet (a punch carpet, for example) is being cleaned with floor nozzle 17 pushed and pulled at an ordinary speed. Not so large a suction is needed, so that the current to the electric blower 7 is somewhat reduced.

According to [Rule 5], where "the current $I_{max}$ is somewhat small" and "the time T is long", a thin carpet (a punch carpet, for example) is pushed and pulled with floor nozzle 17 being slided at a low speed. It is possible to suck dust even if the suction power is considerably reduced, so that the current to the electric blower 7 is considerably reduced.

According to [Rule 6], where "the current $I_{max}$ is small", a surface of a floor such as a tatami mat or a board floor where dust is liable to be absorbed is being cleaned, so that the current to the electric blower 7 is considerably reduced.

According to [Rule 7], where "the current $I_{max}$ is very small", a corner of a room or the like is being cleaned with floor nozzle 17 suspended, so that the current to the electric blower 7 is somewhat large to suck dust from the corner of the room.

On the other hand, if sliding operation part 23 of operation notch control part 39 is switched from the fuzzy control position to any of the manual control positions "weak" to "high power", a signal corresponding to that control position is sent to microcomputer 38, blower control triac 37 is controlled according to the signal, and electric power corresponding to the selected manual control position is supplied to electric blower 7.

As described above, in an embodiment of the present invention, the input to electric blower 7 can be optimized in accordance with the conditions of use of floor nozzle 17 and the types of floor surface performing the fuzzy inference procedure on the current $I_{max}$ of brush driving motor 19 and the interval T of adjacent maxima of its electric current waveform. However, it is also possible to control the electric blower in accordance with the conditions of use of floor nozzle 17 by measuring only the interval T and controlling the duty cycle of blower control triac 37 on the basis of T alone without using combination of the current $I_{max}$ and the time T.

Specifically, when time T is short, the load is small for a user quickly slides the floor nozzle back and forth. The duty cycle of blower control triac 37 is to increase the load. When time T is long, the load is large for the user so that it is hard to slide the floor nozzle back and forth. The duty cycle of blower control triac 37 is reduced to make the load small. Such control can be carried out with the circuitry illustrated in FIG. 6, and processing inside microcomputer 38 is simpler than the above-described embodiment.

It is also possible to obtain similar effects by storing all combinations of current $I_{max}$ and time T, for example, and controlling the current to electric blower 7 according to an actual combination of the current $I_{max}$ and the time T without using the fuzzy inference procedure.

As described above, according to an embodiment of the present invention, the current $I_{max}$ of the brush driving motor and the interval T of adjacent maxima of its waveform are determined, and the, input to the electric blower is controlled according to the result of a mathematical operation on those values, so that it is possible to supply optimum power to the electric blower according to the conditions of use of the floor nozzle and types of the floor surface to realize optimum suction.

Furthermore, it is possible to readily control the electric blower automatically based on human experience and intuition with a simple mathematical operation of choosing a membership function in a fuzzy inference procedure without a complicated control formula or an enormous memory.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electric vacuum cleaner, comprising:

a main body having an electric blower and a dust collecting chamber;

a floor nozzle coupled to said main body and having a rotary brush and a brush driving motor for driving said rotary brush;

electric current detecting means for measuring an amount of an electric current flowing in said brush driving motor;

means for determining a loading period of said motor wherein said loading period is found from comparison of amount of said electric current;

means for performing a predetermined mathematical operation on a value of said loading period as an input and having a power level value as an output; and means for controlling a supply of electric power to said electric blower responsive to said power level value.

2. The electric vacuum cleaner according to claim 1, wherein said means for performing said predetermined mathematical operation includes means for performing a fuzzy inference procedure in which said loading period is an input variable and said power level value is a conclusion part.

3. The electric vacuum cleaner according to claim 1, wherein said electric current detecting means includes a peak hold circuit for holding a peak value of said electric current occurring during a predetermined period, and said peak value represents said amount of said electric current.

4. An electric vacuum cleaner, comprising:

a main body having an electric blower and a dust collecting chamber;

a floor nozzle coupled to said main body and having a rotary brush and a brush driving motor for driving said rotary brush;

electric current detecting means for measuring amounts of an electric current flowing in said brush driving motor;

means for determining a loading period of said motor by comparing said amounts of said electric current;

means for determining a maximum representative value of said electric current for said loading period from said amounts of electric current;

means for performing a predetermined mathematical operation on a value of said loading period and said representative value of said electric current as input variables and having a power level value as an output; and means for controlling a supply of electric power to said electric blower responsive to said power level value.

5. The electric vacuum cleaner according to claim 4, wherein said means for performing said predetermined mathematical operation includes means for performing a fuzzy interference procedure in which said loading period and said representative value are input variables and said electric power level value is a conclusion part.

6. The electric vacuum cleaner according to claim 4, wherein said electric current detecting means includes a peak hold circuit for holding a peak value of said electric current occurring during a predetermined period, and said peak value represents said amount of said electric current.

* * * * *